US006027838A

United States Patent [19]

Rauh et al.

[11] Patent Number: 6,027,838

[45] Date of Patent: Feb. 22, 2000

[54] PHOTOGRAPHIC RECORDING MATERIAL

[75] Inventors: Hans-Jürgen Rauh, Strasslach-Dingharting; Manfred Peters, Leverkusen, both of Germany

[73] Assignee: Agfa-Gevaert N.V., Germany

[21] Appl. No.: 09/093,324

[22] Filed: Jun. 8, 1998

Related U.S. Application Data

[63] Continuation-in-part of application No. 09/059,408, Apr. 14, 1998, abandoned.

[30] Foreign Application Priority Data

Apr. 27, 1997 [DE] Germany ..... 197 16 590

[51] Int. Cl.[7] ..... G03C 1/46; G03C 5/16; G03C 5/26; G03C 11/02

[52] U.S. Cl. ..... 430/22; 430/15; 430/346; 430/394; 430/502; 430/538; 430/944; 430/945; 430/964

[58] Field of Search ..... 430/22, 15, 502, 430/394, 944, 964, 538, 945, 346

[56] References Cited

U.S. PATENT DOCUMENTS

| | | | |
|---|---|---|---|
| 2,316,803 | 4/1943 | Michealis | 430/502 |
| 4,312,937 | 1/1982 | Kasper et al. | 430/538 |
| 4,692,394 | 9/1987 | Drexler | 430/394 |
| 5,576,162 | 11/1996 | Papadopoulos | 430/527 |
| 5,677,121 | 10/1997 | Tsuzuki | 430/944 |
| 5,718,994 | 2/1998 | Goedeweeck et al. | 430/502 |
| 5,871,892 | 2/1999 | Dickerson et al. | 430/502 |
| 5,874,205 | 2/1999 | Bourdelais et al. | 430/22 |

*Primary Examiner*—Richard L. Schilling
*Attorney, Agent, or Firm*—Connolly Bove Lodge & Hutz

[57] ABSTRACT

A photographic recording material having a support which has at least one light-sensitive silver halide emulsion layer on one side and at least one layer or layer region which comprises a laser additive on the other side (the reverse side) is outstandingly suitable for printing with a laser coder.

1 Claim, No Drawings

PHOTOGRAPHIC RECORDING MATERIAL

This application is a continuation-in-part-of application Ser. No. 09/059,408, filed Apr. 14, 1998, now abandoned.

This invention relates to a photographic recording material having a support which has at least one light-sensitive silver halide emulsion layer on one side and at least one layer or layer region which can be printed on the other side (the reverse side). The support is preferably a paper material which is coated on both sides with polyethylene (PE).

There is an interest in the printing of information on the reverse side of photographic papers, e.g. the company logo of the paper manufacturer or of the processor, or text and figures which the manufacturer or processor applies at his own wish or at the wish of the customer.

The applied printed image should be of very high quality. As far as possible, the printing operation should proceed at a speed which is completely synchronous with the speed of image processing. The process should be environmentally friendly, should exhibit a flexibility which is as high as possible, and should be economical.

The reverse side of photographic paper is usually provided with an antistatic layer, which consists of a polyelectrolyte as an antistatic additive, a binder system and of additives such as hardeners and wetting agents.

Reverse side coatings of this type are designed so that they can be printed with printers such as inking ribbon printers, thermal printers and inkjet printers which are used for the image processing of photographic papers. The applied printed image does not satisfy the requirements. Particularly mechanical factors like abrasion can result in a reduction of print quality, however. Therefore, there is still a need for improvement here.

What is required is a durable, solvent-resistant printed image which is wipe- and scratch-resistant. In addition, high print quality, printing speed and flexibility, and a high extent of environmental compatibility should be ensured.

SUMMARY OF THE INVENTION

It has now been found that these objects can be achieved if the reverse side contains a laser additive in at least one layer or one layer region and a laser printer is used for printing.

The present invention therefore relates to a photographic material of the type cited at the outset, which contains an effective amount of a laser additive in the PE laminate on the reverse side or in the internal material of the support also.

DETAILED DESCRIPTION OF THE INVENTION

These laser additives are functional pigments which trigger contrast-increasing reactions in plastics during laser bombardment. Colour changes of this type can arise due to a dark coloration of the polymer matrix in the surroundings of the pigment which results from partial carbonisation, wherein it is principally only the pigment particles near the surface which are involved, so that more progressive damage, to the substrate, can be ruled out. A colour change can also be caused, however, by a discoloration within the pigment itself Finally, a visual change may also be the result of bubble formation at the surface. This is the situation in particular for plastics which exhibit no tendency or only a slight tendency towards carbonisation. In the latter case, a light to white marking is formed. Depending on the plastic, the pigment and the type of laser, markings are possible which range from white via grey to black.

Laser additives (laser-markable plastics) are known from EP 750 012, WO 95/30 546 and EP 718 378, for example.

Examples of laser additives which are particularly suitable are those which are marketed by the Merck company, of Darmstadt, under the trade name Iriodin® LS pigments (LS=laser-sensitive). Moreover, it is also possible to obtain certain gloss effects by admixing these with effect pigments, such as Iriodin® pearl gloss pigments.

Incorporation into the PE laminate layer can be effected by direct addition to a compound. The additives may also be added as a master batch with an additive content of from 5 to 50% by weight, for example. Even small added amounts of the pigment active ingredient are sufficient to achieve a contrast effect due to the laser. As a band width, a range from 0.1 to 10.0% by weight can be added. The addition does not have a significant effect on the material properties of the layer matrix.

A prerequisite for laser coding is that a laser is used, the radiation of which has a wavelength range outside the photographic sensitivity. $CO_2$ lasers with a wavelength in the $\mu$m range and YAG lasers with a wavelength above 1000 nm are particularly suitable.

Lasers of this type have a high output capacity. They make it possible to achieve high printing speeds and sharp-edged images, even for small-scale images. The inscription may be produced via pre-aligned masks, for example, and the inscription may also be produced on moving typesetting copies, in the present case on the reverse side, of travelling photographic strips. A variable printed image can also be produced by deflecting the laser beam in the x-y direction. The input can be programmed via computer programs and thus facilitates a high degree of flexibility.

A detailed summary of the process described here is given in a brochure of the Merck company on the topic of Iriodin® LS for the laser-marking of plastics.

EXAMPLE

Iriodin® LS 825, manufactured by Merck, was incorporated as a master batch in the PE laminate on the reverse side of a colour negative paper comprising paper as a support which was coated on both sides with PE. The master batch contained 10% by weight of Iriodin® LS 825 and the PE laminate contained 6% of the master batch. The incorporated product is a nearly transparent pigment, so that the visual white impression of the reverse side of the photographic material remained substantially unchanged. The characters were marked with a Nd: YAG laser. A sharp-edged, easily legible print image with a medium grey gradation was obtained. No damage occurred to the PE laminate.

We claim:

1. A process for printing the reverse side of a photographic recording material, characterised in that a photographic recording material having a support which has one light-sensitive silver halide emulsion layer on one side and at least one layer or layer region which comprises a laser additive on the other side (the reverse side) is printed with a laser coder based on a YAG laser.

* * * * *

UNITED STATES PATENT AND TRADEMARK OFFICE

CERTIFICATE OF CORRECTION

PATENT NO. : 6,027,838
DATED : February 22, 2000
INVENTOR(S) : Hans-Jürgen Rauh et al.

It is certified that error appears in the above-identified patent and that said Letters Patent is hereby corrected as shown below:

Column 1,
Line 61, "itself Finally" should read -- itself. Finally --.

Column 2, claim 1,
Line 58, "has one" should read -- has at least one --.

Signed and Sealed this

Twelfth Day of February, 2002

*Attest:*

*Attesting Officer*

JAMES E. ROGAN
*Director of the United States Patent and Trademark Office*